US007782718B2

(12) United States Patent
Gallet et al.

(10) Patent No.: US 7,782,718 B2
(45) Date of Patent: Aug. 24, 2010

(54) ANALOGUE TIME DISPLAY FOR MOTOR VEHICLE

(75) Inventors: Laurent Gallet, Neuchâtel (CH); Martin Strahm, Boudry (CH); Xavier Tinguely, Dombresson (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 123 days.

(21) Appl. No.: 11/750,648

(22) Filed: May 18, 2007

(65) Prior Publication Data

US 2007/0268786 A1 Nov. 22, 2007

(30) Foreign Application Priority Data

May 18, 2006 (EP) ..... 06114174

(51) Int. Cl.
*G04F 5/00* (2006.01)

(52) U.S. Cl. ..... 368/157

(58) Field of Classification Search ..... 368/157, 368/47, 160, 200, 189–190
See application file for complete search history.

(56) References Cited

U.S. PATENT DOCUMENTS 4,094,137 A * 6/1978 Morokawa ..... 368/200
4,684,262 A * 8/1987 Meister ..... 368/157
2004/0105347 A1* 6/2004 Fujimori et al. ..... 368/293
2005/0041533 A1* 2/2005 Fujisawa et al. ..... 368/47
2005/0105400 A1 5/2005 Luk
2006/0187762 A1* 8/2006 Ogasawara ..... 368/157

FOREIGN PATENT DOCUMENTS

DE 44 24 337 A1 1/1996
EP 0 560 321 A2 9/1993
EP 0591 557 A1 4/1994

OTHER PUBLICATIONS

European Search Report issued in corresponding application No. EP 06 11 4174, completed Oct. 9, 2006.

* cited by examiner

*Primary Examiner*—Edwin A. Leon
(74) *Attorney, Agent, or Firm*—Griffin & Szipl, P.C.

(57) ABSTRACT

The invention concerns an electronic watch including analogue display means formed of at least one hand (10) driven by a stepping motor (12), at least one time base (24, 26) for providing time data (h. m) to means (16) for controlling and driving said stepping motor, a main power source (20), means (22) for detecting a lack of sufficient power from said main power source, non-volatile storage means (32) powered by an additional power source (28), for containing said time data when a lack of sufficient power is detected, and characterized in that said non-volatile storage means are further provided for containing the stepping motor position data (μpas) when said lack of sufficient power is detected.

8 Claims, 3 Drawing Sheets

ANALOGUE TIME DISPLAY FOR MOTOR VEHICLE

This application claims priority from European Patent Application No. 06114174.3, filed May 18, 2006, the entire disclosure of which is incorporated herein by reference.

FIELD OF THE INVENTION

The present invention generally concerns an electronic watch with an analogue display or other displays with hands to be integrated into the dashboard of a motor vehicle, and more particularly a method of electromechanical synchronisation between the analogue display and the time counter of the watch.

BACKGROUND OF THE INVENTION

Devices for resetting the time of an electronic watch ensuring some electromechanical synchronism are known from the prior art. This type of electronic watch that is to be integrated into a dashboard of a motor vehicle includes analogue display hands formed of an hour hand and a minute hand driven by a stepping motor. The stepping motor used in such electronic watches is generally formed of a magnetised rotor, a stator and a coil which when it is powered creates a magnetic field in the stator which is converted into a magnet whose polarity depends upon the direction of the current in the coil. At each pulse received from the time base, the rotor makes one step driving the gear trains and the hands of the watch in a conventional manner.

This type of electronic watch further includes a power source, time counting means operating in synchronism with the display means for sufficient powering and means for detecting insufficient power. When insufficient power is detected, the hands are stopped and the corresponding value (hours, minutes) of the counting means is then stored in non-volatile storage means.

Nonetheless, it was demonstrated within the scope of the present invention, that this synchronisation method was not sufficiently reliable over time. Indeed, when the type of stepping motor described above is not being powered, it has at least two magnetically stable positions resulting from its geometry. Thus, each time the power is insufficient, the motor stopping very often causes a loss of time information insofar as the motor is statistically not in one of the two magnetically stable positions when it stops and that following the stop it inevitably returns to one of its magnetically stable positions. Depending upon the gear reduction applied between one step of the motor and the information of one minute, the accumulation of these errors can exceed several minutes and become unacceptable for providing correct time information.

Certain prior art solutions suggest using hand position detectors for calculating and correcting this error between the actual position of the hands and that indicated in the time counting means. Such solutions are often complex and are, moreover, not necessarily very reliable.

SUMMARY OF THE INVENTION

It is one of the main objects of the present invention to overcome the aforementioned drawbacks by means of an electronic watch provided with means providing reliable electromechanical synchronisation taking account of the type of stepping motor used. Thus, a first object of the invention concerns an electronic watch comprising analogue display means formed of at least one hand driven by a stepping motor, at least one time base for providing time information to means for controlling and driving a stepping motor, a main power source, means for detecting insufficient power supply from the main power source, non-volatile storage means powered by an additional power source, for containing time information when said insufficient power supply is detected. The watch is further characterized in that the non-volatile storage means are further provided for containing stepping motor position information when an insufficient power supply is detected.

A second object of the present invention concerns a reliable electromechanical synchronisation method for such an electronic watch. Thus, the method comprises the steps consisting in (a) detecting insufficient supply from the main power source; (ii) stopping the watch motor; (iii) using the additional power source as a power source; (iv) writing the time information in the non-volatile storage means when the insufficient power supply is detected. The method is characterized in that it further includes an additional step consisting in (v) writing the position of the stepping motor in the non-volatile storage means when the insufficient power supply is detected.

Advantageous embodiments are given with the dependent claims.

BRIEF DESCRIPTION OF THE DRAWINGS

Other features and advantages of the present invention will appear more clearly upon reading the following detailed description of embodiments of the invention given solely by way of non-limiting example and illustrated by the annexed drawings, in which.

DETAILED DESCRIPTION OF THE INVENTION

Figure 1:
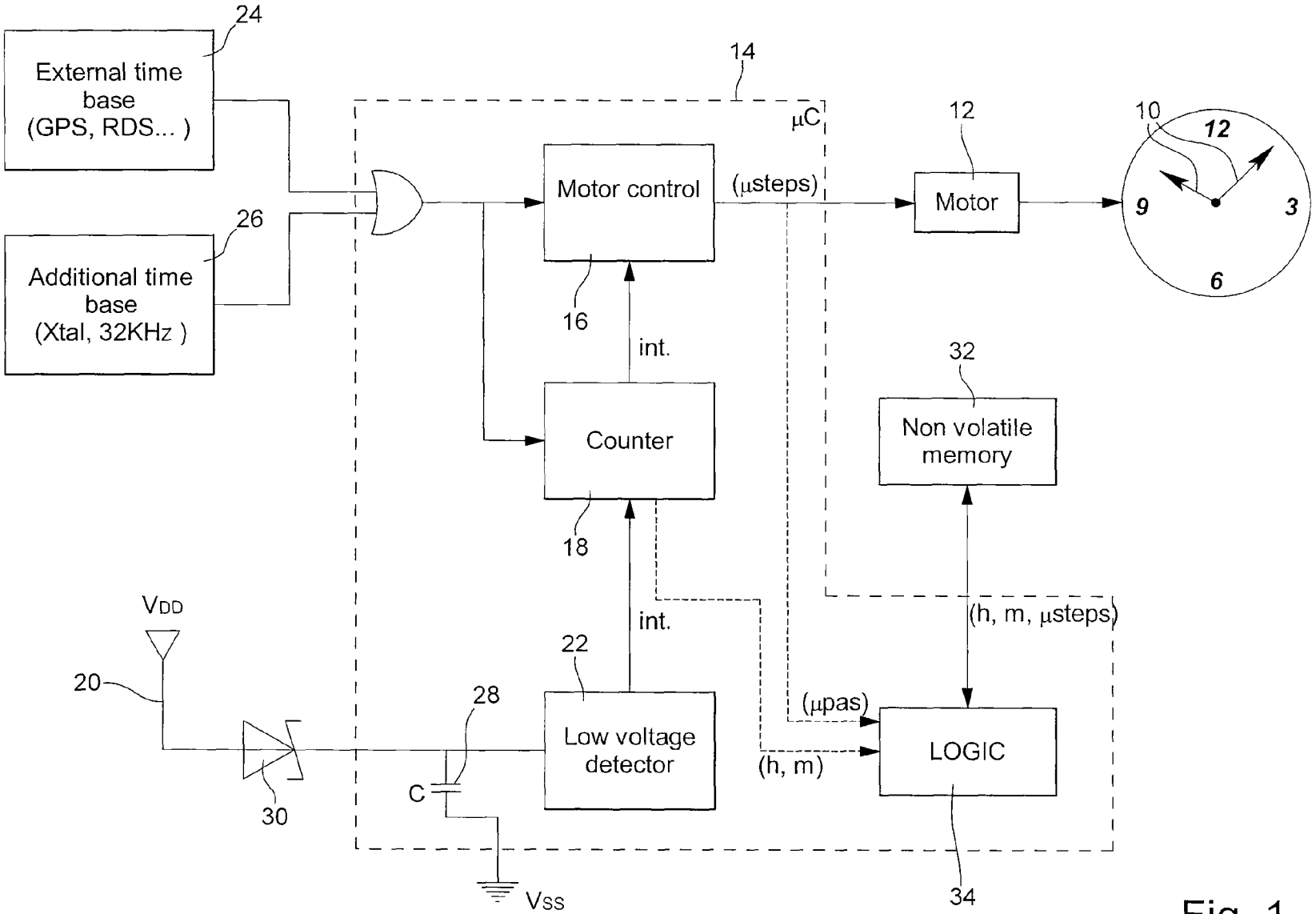
FIG. 1 shows an overall view of an electronic watch according to one embodiment of the present invention.

The various embodiments which will now be presented are given purely by way of non-limiting illustration. FIG. 1 shows an overall view of an electronic watch according to a preferred embodiment of the present invention.

This electronic watch includes analogue display means 10 preferably including two hands, namely an hour hand and a minute hand. These analogue display means 10 are activated by means of a stepping motor 12 which will be described in more detail with reference to FIGS. 2, 3*a* and 3*b*. This stepping motor 12 is formed in a conventional manner by a rotor, a stator and at least one coil. The magnetised rotor is mounted on a pinion which drives the gear trains of the watch connected to the hands of the display. Gear reduction wheels and pinions with ratios of 1:60 and 1:12 respectively drive the minute hand and the hour hand.

The watch comprises a microcontroller circuit 14 including motor control and drive means 16 for moving the motor forward, a volatile time counter 18, for example a RAM memory, for containing time data that is periodically updated when the supply voltage of microcontroller 14 is sufficient for the electronic watch to operate properly. Thus, microcontroller 14 is powered by means of a main power source 20, for example the regulated battery of a motor vehicle as regards the electronic watch integrated in such a vehicle or any other regulated power source. Microcontroller 14 also includes a low voltage detector 22 for detecting when the supply voltage provided by the main power source is no longer sufficient to enable the electronic watch to operate properly.

It should be noted that the microcontroller 14 comprises an internal oscillator, not shown, for clocking the microcontroller. The working frequency of the oscillator after frequency division is advantageously selected such that it is higher than frequencies audible to certain pets that may travel in a motor vehicle. For this purpose, the working frequency of the microcontroller is preferably selected to be 32 KHz.

The electronic watch further includes at least one time base or alternatively means for receiving time information from an external time base 24. The time information received is displayed, on the one hand, in an analogue manner, and on the other hand contained electrically in counter 18, counter 18 and hands 10 operating synchronously. Advantageously, the watch includes an additional time base 26 formed of a quartz oscillator and frequency dividers providing time information and additionally means for receiving other true time information from an external time base 24 that may be obtained for example from a GPS or RDS receiver.

The time information updated in time counter 18 of the watch is advantageously that from the external time base 24 which is deemed to be true. However, in the absence of received signals containing this true time information from this external time base 24, microcontroller 14 then uses in its place the time information provided by the additional time base 26.

As mentioned above, microcontroller 14 includes low voltage detection means 22, also called insufficient power supply detection means. These detection means 22 compare the supply voltage received by the main power source 20 with a determined reference voltage that is sufficient for the electronic watch to operate properly. As soon as a lack of sufficient power is detected, the watch enters as a priority over any other operating mode into an operating mode called the low power consumption mode in which counter 18 is no longer incremented and the motor control and drive means 16 are deactivated (via the "int" signal) and consequently motor 12 and hands 10 are stopped. Detection of this lack of sufficient power in the example of a watch powered by the battery of a motor vehicle could for example occur when the vehicle's battery is being changed or at the end of the latter's life. Thus, since the power supplied by the main source 20 is by definition insufficient for the proper operation of the watch generally and for microcontroller 14 in particular, an additional power source is provided, such as for example an energy buffer like a capacitor 28 connected to the terminals of the power supply, and having a capacitance C selected to provide sufficient energy to the operations necessary for ensuring reliable electromechanical synchronism between the real position of hands 10 and the corresponding time information in counter 18. A zener diode 30 is placed between the main power source 20 and capacitor 28 so as to prevent any discharging of the latter once the main power supply becomes insufficient.

Following detection of a lack of sufficient power supplied by the main source 20, the charge stored in capacitor 28 is then used to provide the energy necessary for writing the time information contained in the volatile time counter 18 in a non-volatile memory 32 (such as for example an EEPROM). However, as was demonstrated within the scope of the present invention, simply storing the time information is not sufficient to ensure reliable electromechanical synchronism between the real position of hands 10 and the corresponding time information in counter 18. This is why the energy provided by the additional power source is also provided in order to write the motor position information when a lack of sufficient power is detected. The motor position information provided by the motor control and drive means 16 is copied into non-volatile memory 32 via the logic 34 of microcontroller 14. This motor position information will now be described in more detail in relation to FIGS. 2, 3*a* and 3*b*.

Figure 2:
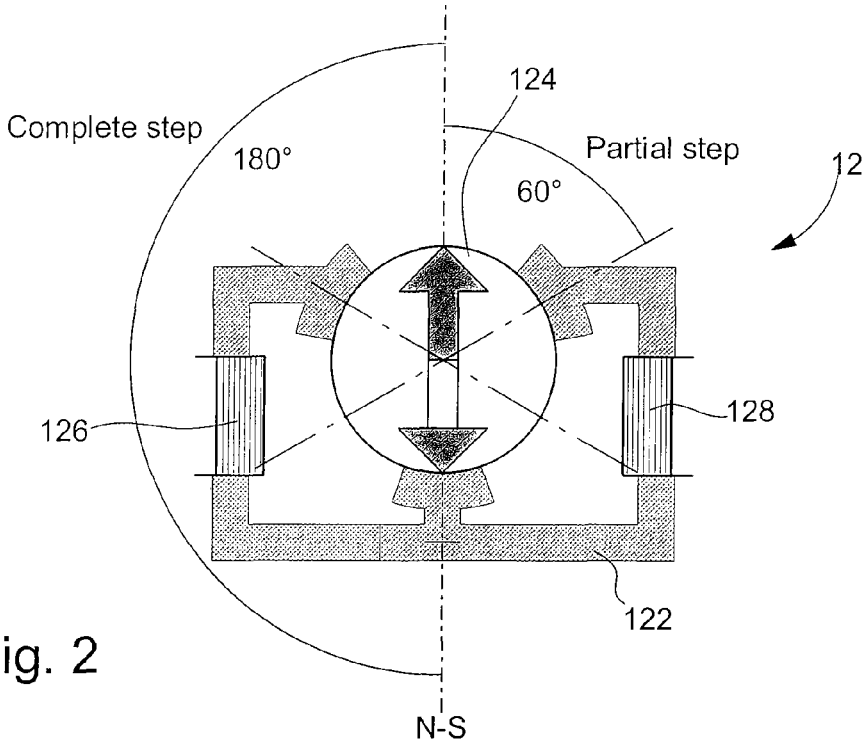
FIG. 2 shows a schematic view of a stepping motor having a North-South magnetic magnetisation axis defining two stable magnetic positions.

As was mentioned previously, the forward movement of the watch hands is controlled by a stepping motor 12, an example of which is given in FIG. 2, which shows schematically a stepping motor of this type with a North-South axis of magnetisation. The slots on stator 122 define two stable magnetic positions of rotor 124 in one of which the rotor is placed when the stator is not being magnetised, i.e. when the current in the coil(s) 126 (and 128) is cut.

According to a particular embodiment, one complete revolution of the rotor 124 corresponds to a movement of one minute of the minute hand i.e. to a movement of 6° of this hand. The rotor takes two complete steps, during one complete revolution, each complete step corresponding to a movement of 3° of the minute hand. A movement of 1° of the same minute hand defines a partial step of the rotor, corresponding to a rotation of the latter through 60°.

During the normal operation of the watch, i.e. when the supply voltage supplied is sufficient, the motor is controlled such that it makes 24 microsteps per complete rotation of the rotor and consequently 24 intermediate positions per minute for the minute hand.

Figure 3A:
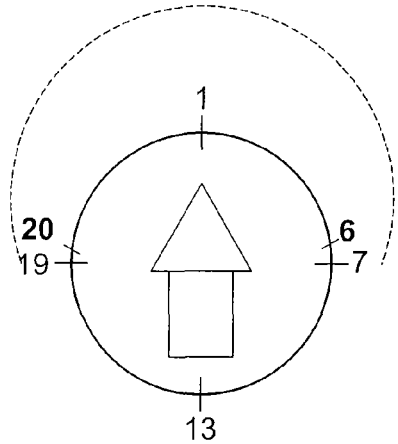
FIGS. 3*a* and 3*b* show schematic views of the rotor in one or other of the stable magnetic positions after detection of insufficient power supply.
Figure 3B:
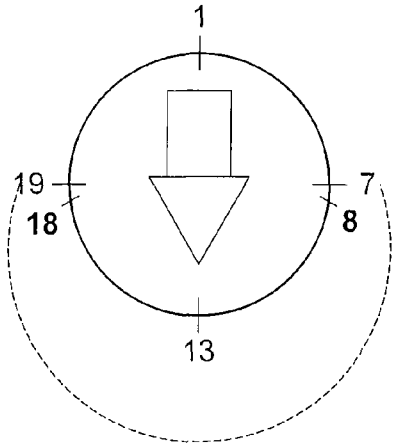

As is visible in FIGS. 3*a* and 3*b* respectively, the first stable position is arbitrarily defined as corresponding to step no. 1, and respectively the second stable position is arbitrarily defined as corresponding to microstep no. 13. If one considers one microstep of the rotor, it is equal, according to the above considerations, to ¼° of a movement of the minute hand, i.e. 4 microsteps for a movement of 1°.

Let us now consider FIG. 3*a*. All of the positions of the rotor defined by the microsteps between microsteps no. 20 and no. 6 inclusive (i.e. microsteps nos. 20-24 and no. 1-6) are positions from which the rotor will go into the stable position defined by microstep no. 1 when there is insufficient power or a power cut.

Conversely, if we consider FIG. 3*b*, all of the positions of the rotor defined by the microsteps between microsteps no. 8 and no. 18 inclusive are positions from which the rotor will go into the stable position defined by microstep no. 13 when there is insufficient power or a power cut.

Thus, depending upon the exact position in which the rotor is located when a lack of sufficient power is detected, and in the knowledge that the rotor will automatically return to one of the two stable positions (no. 1 or no. 13) after the motor has been stopped, the information capable of being lost varies between 0 and 6 microsteps, namely between 0 and 1.5° or between 0 and 15 seconds.

It will be noted here that if the motor is cut when the rotor is in the position defined by microsteps no. 7 or no. 19, then it will randomly go into one or other of the stable positions defined by the microsteps no. 1 and no. 13. This is why the position into which it is supposed to go to carry out the true time reset is arbitrarily selected.

It will also be noted that the speed of the motor is preferably chosen to be maximal, so as to prevent losing a step that is in the process of being made when a lack of sufficient power/power cut is detected, which is due to a lack of inertia of the motor.

Figure 4:
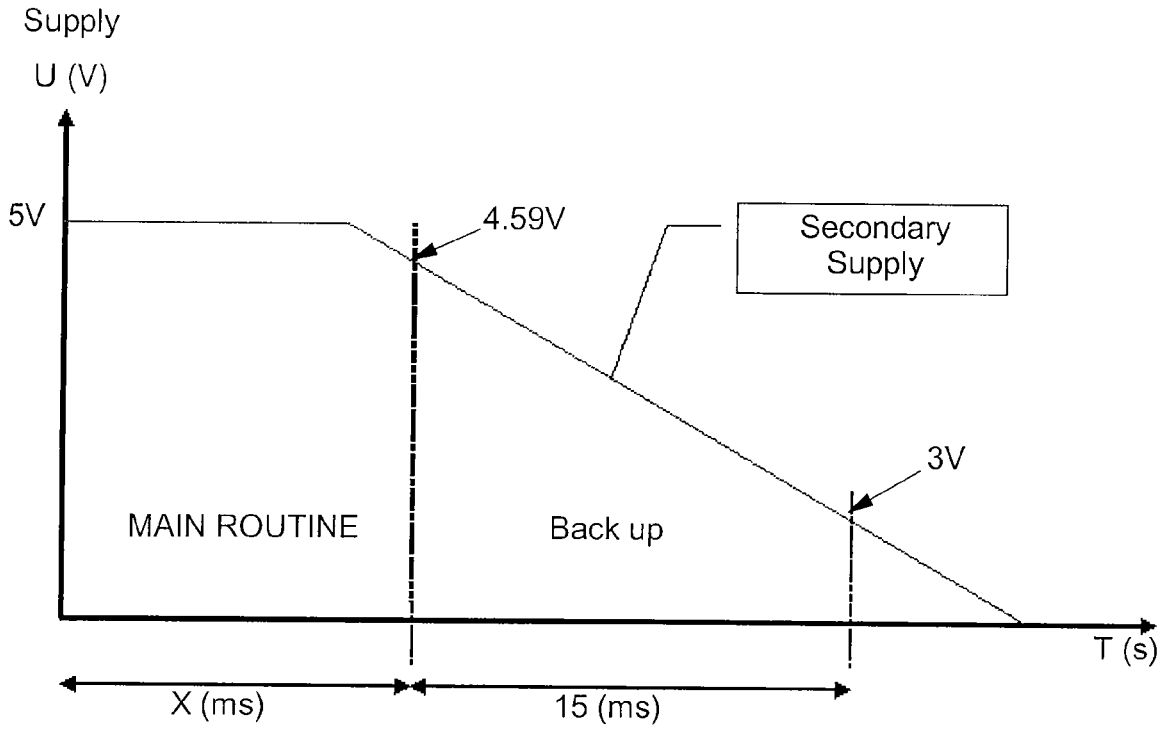
FIG. 4 shows a diagram of the electromagnetic synchronisation backup procedure according to the invention.

FIG. 4 shows a diagram of the electromechanical synchronisation backup procedure according to the invention.

In a main operating mode (Main), the system checks whether an external clock signal (for example a GPS signal) is present, then the microcontroller, after reading the received signals, increments the time counter values and controls the motor pulses, the hands indicating the time received by these signals being then moved in synchronism.

In the absence of external clock signals, the system activates an autonomous mode via a routine (Stand Alone) and at the same time uses an internal clock to count down the time and control the motor and update the hour, minute and microstep information.

In the case of detection of a lack of sufficient power, the system passes into a low power mode (Low Power Mode) defined in a priority routine over all the other modes. In this low power mode the stepping motor is stopped and the hour, minute and microstep information is backed up in a non-volatile memory (e.g. EEPROM).

When the power becomes sufficient again, for example when the vehicle battery has been replaced, the watch resets the system to the correct time by means of the true time information obtained by the external time base.

It will be understood that various alterations and/or improvements and/or combinations that are evident to those skilled in the art can be made to the various embodiments of the invention explained hereinbefore without departing from the scope of the invention defined by the annexed claims. It will be noted for example that a rotor can have several axes of magnetisation depending upon the design of the motor and can thus define multiple of two stable positions.

What is claimed is:

1. An electronic watch including:

(a) analogue display means formed of at least one hand driven by a stepping motor, wherein said stepping motor includes a magnetised rotor including at least two stable magnetic positions relative to a stator, and a defined number of intermediate positions corresponding to a number of microsteps of said stepping motor over a complete rotation of said magnetised rotor, wherein said number of microsteps is higher in number than the number of stable magnetic positions;

(b) at least one time base for providing first time data to means for controlling and driving said stepping motor;

(c) a main power source;

(d) means for detecting a lack of sufficient power from said main power source; and (e) non-volatile storage means, wherein the electronic watch operates in a normal operation mode when said main power source provides sufficient power and the electronic watch enters into a low power mode upon detection of the lack of sufficient power, wherein in the low power mode said stepping motor is stopped, and wherein when the electronic watch enters into the low power mode, the electronic watch stores the first time data and a first intermediate position of the rotor in the non-volatile storage means, and when the electronic watch is again sufficiently supplied with power from the main power source, the electronic watch again enters into the normal operation mode and the at least one hand is again synchronized with the first time data by taking into account the first intermediate position stored in said non-volatile storage means and a first stable magnetic position in which said rotor had gone when the electronic watch last entered into the low power mode.

2. The electronic watch according to claim 1, further including means for receiving true time data from a first external time base, and a second additional time base supplying data used only when said true time data is not received.

3. The electronic watch according to claim 1, further including an additional power source for powering said non-volatile storage means.

4. The electronic watch according to claim 3, wherein the additional power source is a capacitor.

5. The electronic watch according to claim 3, further including means for receiving true time data from a first external time base, and a second additional time base supplying data used only when said true time data is not received.

6. A method of electromechanical synchronisation of at least one hand and true time data for an electronic watch, wherein the electronic watch includes:

(a) analogue display means formed of at least one hand driven by a stepping motor, wherein said stepping motor includes a magnetised rotor including at least two stable magnetic positions relative to a stator, and a defined number of intermediate positions corresponding to a number of microsteps of said stepping motor over a complete rotation of said magnetised rotor, wherein said number of microsteps is higher in number than the number of stable magnetic positions;

(b) at least one time base for providing first time data to means for controlling and driving said stepping motor;

(c) a main power source;

(d) means for detecting a lack of sufficient power from said main power source; and (e) non-volatile storage means, wherein the electronic watch operates in a normal operation mode when said main power source provides sufficient power and the electronic watch enters into a low power mode upon detection of the lack of sufficient power, wherein in the low power mode said stepping motor is stopped, wherein the method of electromechanical synchronisation includes the steps of i. detecting a lack of sufficient power from said main power source;

ii. the electronic watch entering into the low power mode stopping said stepping motor when the lack of sufficient power from said main power source is detected, wherein the first time data and a first intermediate position of the rotor are stored in said non-volatile storage means when the electronic watch enters into the low power mode, and the rotor goes to a first stable magnetic position when the electronic watch enters into the low power mode;

iii. the electronic watch entering the normal operation mode when the electronic watch is again sufficiently supplied with power from said main power source;

iv. synchronizing again said at least one hand with the first time data by taking into account the first intermediate position stored in said non-volatile storage means and the first stable magnetic position of the rotor.

7. The method according to claim 6, wherein an additional power source is used to provide power used for writing the first time data and the first intermediate position of the rotor in said non-volatile storage means.

8. The method according to claim 7, wherein the additional power source is a capacitor.

* * * * *